United States Patent [19]

Sova

[11] Patent Number: 4,563,257

[45] Date of Patent: Jan. 7, 1986

[54] METHOD OF ELECTROLYTICALLY POLISHING A WORKPIECE COMPRISED OF A NICKEL-, COBALT-, OR IRON-BASED ALLOY

[75] Inventor: Vladimir Sova, Mellingen, Switzerland

[73] Assignee: BBC Brown, Boveri & Company Limited, Baden, Switzerland

[21] Appl. No.: 642,656

[22] Filed: Aug. 21, 1984

[30] Foreign Application Priority Data

Aug. 23, 1983 [CH] Switzerland ..... 4580/83-2

[51] Int. Cl.[4] ..... C25F 3/22; C25F 3/24

[52] U.S. Cl. ..... 204/129.85; 204/129.9; 204/129.95

[58] Field of Search ..... 204/129.75, 129.85, 204/129.9, 129.95

[56] References Cited

U.S. PATENT DOCUMENTS

| | | | |
|---|---|---|---|
| 3,239,440 | 3/1966 | Covington | 204/129.95 |
| 3,342,711 | 9/1967 | Shiga | 204/129.95 |
| 3,389,065 | 6/1968 | Shibasaki | 204/129.95 |
| 3,627,654 | 12/1971 | Petit | 204/129.95 |

*Primary Examiner*—T. M. Tufariello

*Attorney, Agent, or Firm*—Oblon, Fisher, Spivak, McClelland & Maier

[57] ABSTRACT

A method of electrolytically polishing Fe-, Co-, and Ni alloys, particularly nickel superalloys, wherein at least one fluorine compound is mixed into the electrolyte, which electrolyte is based on a strong acid and is further comprised of at least one weakly polar organic compound and a fluorinated surfactant. The preferred fluorine compound is $HBF_4$, added the amount of 5 to 40 vol. %. Other fluorine compounds which perform well are ammonium bifluoride, HF, and sodium fluosilicate.

12 Claims, No Drawings

METHOD OF ELECTROLYTICALLY POLISHING A WORKPIECE COMPRISED OF A NICKEL-, COBALT-, OR IRON-BASED ALLOY

BACKGROUND OF THE INVENTION

1. Field of the Invention

The invention has been developed from a method of electrolytically polishing a workpiece comprised of a nickel-, cobalt-, or iron-based alloy.

2. Description of the Prior Art

In the electrolytic polishing of metals and alloys of Groups IV B, V B, VI B, and VIII of the periodic table of the elements, the electrolytes used in most cases are based on concentrated acids such as sulfuric, phosphoric, or nitric. The action of the acid is intended to preferentially remove surface roughness during the anodic treatment of the metal objects (i.e., electromachining). With proper adjustment of the operating conditions this roughness removal can lead to smoothing of the surface. Various theories have been developed to explain the electropolishing process. For the most part these theories deal with the physical properties of the electrolytes. For example, the viscosity of the electrolytes is an important factor in diffusion at the anode. Another factor is the conductivity, which affects the current-voltage (current vs. voltage) characteristic.

Electrolytic polishing of rust-free steels is known from, e.g., Ger. Pat. No. 938,402, Ger. Pat. No. 754,703, Ger. AS No. 1,913,570, and U.S. Pat. No. 3,751,352. The corresponding process for superalloys is described in, e.g., Ger. OS No. 26 54 484.

Electrolytic polishing is comprised chiefly of two processes, which need to be carried out simultaneously: smoothing of the surface, i.e. the preferential dissolution of macroscopic and microscopic surface roughness without grain attack in the depressions, and dissolution of the metal oxide layer formed on the surface. In treating alloys, there is a third aspect which is even more important, namely the need to uniformly dissolve all the components of the metal. It is more difficult to achieve uniform dissolution of all the metals in the alloy to the extent that the component metals are from different groups of the periodic system. In nickel-based alloys of very complex composition (e.g., superalloys such as the "Nimonics") an electrolytic polishing effect may be achieved by the ordinary methods, but the result is a dull, matte surface, due to uneven dissolution of the different component metals, and also possible concentration of the difficulty soluble components at the surface being treated. An electrolyte based on perchloric acid has provided good electropolishing results, but such an electrolyte is not industrially feasible, because, e.g. the operating temperature required is too low, and there is a hazard of later corrosive attack through decomposed chloride ions. In addition, with perchloric acid there is an explosion risk, and the useful life of the electrolytes is too short.

Therefore, improvements are needed in the conventional methods of electrolytic polishing.

The problem giving rise to the invention is to devise a method of electrolytically polishing a workpiece comprised a nickel, cobalt, or iron alloy, particularly a superalloy, which method yields clean, smooth workpiece surfaces and can be carried out without explosion hazards, under normal shop conditions, at room temperature and at ambient temperatures. The electrolyte employed should have a high useful life.

SUMMARY OF THE INVENTION

Accordingly, one object of this invention is to provide a novel method of electrolytically polishing a workpiece composed of nickel-, cobalt-, or an iron-based alloy by means of an electrolyte composed of a concentrated, non-oxidizing acid, a fluorinated surfactant and a weakly polar organic compound.

In accordance with the present invention the workpiece is first degreased, then electrolytically polished, and finally rinsed and dried.

The present invention is further characterized in that a fluorine compound in the form of a simple or complex fluoride is mixed into the electrolyte in the amount of at least 2 vol. %. The electrolytic polishing is carried out in a temperature range of between −20° and +30° C. for a time of 20 secs. to 20 mins., with anodic current densities of 20 to 250 A/dm$^2$ and cell voltages of 20 to 70 V.

DETAILED DESCRIPTION OF THE PREFERRED EMBODIMENTS

The invention will now be described in more detail with the aid of the following exemplary embodiments.

EXEMPLARY EMBODIMENT 1

To prepare the electrolysis bath, 6 volumes conc. $H_2SO_4$ were first mixed with 2 volumes $C_2H_5OH$. Then 1 volume $HBF_4$, followed by 1 volume glycerine and 0.1 vol.%* of a fluorinated surfactant (e.g. tenside containing fluorine) were added, after which the bath was cooled to the working temperature of 0° C.

*based on the total volume of components added to produce the electrolyte

The prepared electrolysis bath had the following approximate composition:

| | |
|---|---|
| Conc. $H_2SO_4$ | 60 vol. % |
| Ethanol | 20 vol. % |
| Glycerine | 10 vol. % |
| $HBF_4$ | 10 vol. % |
| Fluorinated surfactant | 0.1 vol. % |

The workpiece to be electrolytically polished was a blade (or vane) of a gas turbine comprised of a nickel superalloy with the commercial name Nimonic. The workpiece was first degreased in organic solvents and then mounted in a suitable suspension device (frame). The frame was suspended in the electrolyte bath with the workpiece as the anode and a cell voltage of 50 V was applied. Electrolytic polishing was carried out for 3 min at a current density of 80 A/dm$^2$ and a temperature of about 0° C. At the end of the polishing period the current was switched off, and the workpiece in the frame was removed from the bath and rinsed several times in cold and warm water. Then the workpiece was dried in a stream of hot air at 80° to 90° C. Following its removal from the frame and cooling to room temperature the workpiece displaced a smooth, reflective surface.

EXEMPLARY EMBODIMENT II

To prepare the electrolysis bath, 3 volumes conc. $H_3PO_4$ were mixed with 5 volumes $C_2H_5OH$, 1 volume glycerine, and 1 volume ammonium bifluoride ($NH_4.HF_2$) containing 0.1 vol.% based on the total (see footnote, supra) of a fluorinated surfactant, after which the bath was cooled to the working temperature of −10° C.

The prepared electrolysis bath had the following approximate composition:

| | |
|---|---|
| Conc. $H_3PO_4$ | 30 vol. % |
| Ethanol | 50 vol. % |
| Glycerine | 10 vol. % |
| Ammonium bifluoride | 10 vol. % |
| Fluorinated surfactant | 0.1 vol. % |

The workpiece was comprised of a nickel-based superalloy with the commerical name Hastelloy. Prior to the electrolytic polishing it was degreased in organic solvents (trichloroethylene and tetrachloroethylene) and then mounted in a device similar to the frame of Example I. The workpiece with the frame was immersed in the said electrolysis bath, where the workpiece and frame served as the anode. Electrolytic polishing was carried out for 5 min with cell voltage adjusted to 20 V. Subsequent handling of the workpiece (including rinsing, drying, etc.) was as in Example I.

EXEMPLARY EMBODIMENT III

To prepare the electrolysis bath, 2 volumes conc. $H_3PO_4$ and 2 volumes conc. $H_2SO_4$ were mixed with 2 volumes $C_2H_5OH$ and 2 volumes 2-propanol. In addition, a solution of 1 volume sodium fluosilicate and 1 volume HF containing 0.1 vol.% based on the total (see footnote, supra) of a fluorinated surfactant was prepared and was added to the first mixture. The bath thus prepared was brought to a working temperature of 12° C.

The resulting prepared electrolysis bath had the following approximate composition:

| | |
|---|---|
| Conc. $H_3PO_4$ | 20 vol. % |
| Conc. $H_2SO_4$ | 20 vol. % |
| Ethanol | 20 vol. % |
| 2-Propanol | 20 vol. % |
| HF | 10 vol. % |
| Sodium fluosilicate | 10 vol. % |
| Fluorinated surfactant | 0.1 vol. % |

The workpiece was a fabricated piece comprised of an austenitic steel alloy of type XlOCrNiW 17/13. It was first degreased in inorganic solvents and then mounted in a suitable frame. The procedure continued as in Example I; except that the cell voltage was maintained at 70 V during the electrolytic polishing, and the duration of the polishing was 7 min.

The invention is of course not limited to the exemplary embodiments. The method is basically applicable to nickel-, cobalt-, or iron-based alloys. In the case of iron-based alloys, the main candidates are austenitic materials.

The electrolyte, as a rule comprised of a concentrated, non-oxidizing (to metals) acid such as conc. $H_2SO_4$ or conc. $H_2PO_4$, and further comprised of a fluorinated surfactant and a weakly polar organic compound, additionally has a fluorine compound in the form of a simple or complex fluoride mixed into it in the amount of at least 2 vol.%.

The constant of conc. $H_2SO_4$ or $H_3PO_4$ may be between 20 and 80 vol.%. If both $H_2SO_4$ and $H_3PO_4$ are used simultaneously, advantageously they are present in the amount of 10 to 40 vol.% each.

The weakly polar organic compounds used are preferably $C_2H_5OH$ (10 to 50 vol.%) and glycerine (5 to 40 vol.%). Alternatively, one may use 10 to 30 vol.% of $C_2H_5OH$ and 10 to 30 vol.% of 2-propanol. In any case, the fluorinated surfactant is added to the electrolyte in the amount of c. 0.2 vol.%.

Suitable and typical fluorine compounds for use with the method are $HBF_4$ (in the amount of 5 to 40 vol.% of the total (see footnote supra), ammonium bifluoride (5 to 40 vol.%), or a mixture of HF (5 to 20 vol.%) and sodium fluosilicate (5 to 20 vol.%). Obviously, other combinations of suitable fluorine compounds may be used for carrying out the method.

The electrolytic polishing is advantageously conducted at temperatures between −20° and +30° C. for a time of 20 sec to 20 min, with anode current densities of 20 to 250 A/dm$^2$ and cell voltages of 20 to 70 V.

What is claimed as new and desired to be secured by Letters Patent of the United States is:

1. A method for electrolytically polishing a workpiece composed of a nickel-, a cobalt-, or an iron-based alloy by means of an electrolyte comprising concentrated $H_2SO_4$ in an amount of 20 to 60 vol.%, $C_2H_5OH$ in an amount of 10 to 50 vol.%, glycerine in an amount of 5 to 40 vol.%, $HBF_4$ in an amount of 5 to 40 vol.%, and a fluorinated surfactant in an amount of at least 0.1 vol.%; wherein the said workpiece is first degreased, then electrolytically polished and subsequently rinsed and dried.

2. A method for electrolytically polishing a workpiece composed of a nickel-, a cobalt-, or an iron-based alloy by means of an electrolyte comprising concentrated $H_3PO_4$ in an amount of 20 to 60 vol.%, $C_2H_5OH$ in an amount of 10 to 50 vol.%, glycerine in an amount of 5 to 40 vol.%, ammonium bifluoride in an amount of 50 to 40 vol.%, and a fluorinated surfactant in an amount of at least 0.1 vol.%, wherein the said workpiece is first degreased, then electrolytically polished and subsequently rinsed and dried.

3. A method for electrolytically polishing a workpiece composed of a nickel-, a cobalt-, or an iron-based alloy by means of an electrolyte comprising concentrated $H_2SO_4$ in an amount of 10 to 40 vol.%, concentrated $H_3PO_4$ in an amount of 10 to 40 vol.%, $C_2H_5OH$ in an amount of 10 to 30 vol.%, 2-propanol in an amount of 10 to 30 vol.%, HF in an amount of 5 to 20 vol.%, sodium flurosilicate in an amount of 5 to 20 vol.%, and a fluorinated surfactant in an amount of at least 0.1 vol.%; wherein the said workpiece is first degreased, then electrolytically polished and subsequently rinsed and dried.

4. The method of claim 1, wherein the said method is characterized in that the electrolytic polishing is carried out at a temperature range between −20° and +30° C. for a time of 20 seconds to 20 minutes, with anodic current densities of 20 to 250 A/dm$^2$ and cell voltages of 20 to 70 V.

5. The method of claim 2, wherein the said method is characterized in that the electrolytic polishing is carried out in a temperature range between −20° and +30° C. for a time of 20 seconds to 20 minutes, with anodic current densities of 20 to 250 A/dm$^2$ and cell voltages of 20 to 70 V.

6. The method of claim 4, wherein the said method is characterized in that the electrolytic polishing is carried out in a temperature range between −20° and +30° C. for a time of 20 seconds to 20 minutes, with anodic current densities of 20 to 250 A/dm$^2$ and cell voltages of 20 to 70 V.

7. The method of claim 1, wherein the said fluorinated surfactant is used in an amount of at least 2 vol.%.

8. The method of claim 2, wherein the said fluorinated surfactant is used in an amount of at least 2 vol.%.

9. The method of claim 3, wherein the said fluorinated surfactant is used in an amount of at least 2 vol.%.

10. The method of claim 4, wherein the said fluorinated surfactant is used in an amount of at least 2 vol.%.

11. The method of claim 5, wherein the said fluorinated surfactant is used in an amount of at least 2 vol.%.

12. The method of claim 6, wherein the said fluorinated surfactant is used in an amount of at least 2 vol.%.

* * * * *